United States Patent [19]

Solomon

[11] 4,357,262

[45] Nov. 2, 1982

[54] ELECTRODE LAYER TREATING PROCESS

[75] Inventor: Frank Solomon, Great Neck, N.Y.

[73] Assignee: Diamond Shamrock Corporation, Dallas, Tex.

[21] Appl. No.: 202,573

[22] Filed: Oct. 31, 1980

[51] Int. Cl.[3] ..... C25B 11/03; C25B 11/12; B29D 27/00; C25B 13/08

[52] U.S. Cl. ..... 252/425.3; 204/290 R; 204/294; 264/49; 264/105; 264/127; 427/115; 427/245; 427/353; 429/42

[58] Field of Search ..... 252/425.3, 430; 427/353, 245, 115; 204/290 R, 294, 296; 264/105, 49, 127; 429/42, 44

[56] References Cited

U.S. PATENT DOCUMENTS

| | | | |
|---|---|---|---|
| 3,281,511 | 10/1966 | Goldsmith | 264/49 |
| 3,859,402 | 1/1975 | Bintliff et al. | 264/49 |
| 4,012,541 | 3/1977 | Hirozawa | 427/353 |
| 4,058,482 | 11/1977 | Baris et al. | 252/425.3 |
| 4,170,540 | 10/1979 | Lazarz et al. | 204/296 |
| 4,196,070 | 4/1980 | Chao et al. | 264/49 |
| 4,278,525 | 7/1981 | Gestaut | 204/290 R |
| 4,279,709 | 7/1981 | McIntyre et al. | 427/245 |
| 4,289,600 | 9/1981 | Lazarz et al. | 264/127 |

FOREIGN PATENT DOCUMENTS

| | | | |
|---|---|---|---|
| 1285031 | 12/1968 | Fed. Rep. of Germany . | |
| 472403 | 9/1975 | U.S.S.R. | 252/425.3 |

OTHER PUBLICATIONS

Kroon, D. F. et al., *Elsevier Sequoia Patent Reports,* vol. 5, Fuel Cell Electrodes: Part 1, pp. 62, 132, 1974.

*Primary Examiner*—P. E. Konopka
*Attorney, Agent, or Firm*—John P. Hazzard

[57] ABSTRACT

The present disclosure is directed to a process for treating gas electrodes containing a wetproofing (backing) layer which contains a polytetrafluoroethylene (PTFE) in conjunction with a water-soluble pore-forming agent and a PTFE-containing active layer to preserve and enhance their structural integrity which comprises contacting the electrode first with an alkylene polyol, or other water-soluble organic material having a plurality of hydroxyl groups, at temperatures ranging from about 50° to about 100° C. for a sufficient period of time to thoroughly wet the PTFE-containing active layer thereof, and thereafter contacting the thus-treated electrode with water in one or more washing steps to substantially remove the pore-forming agent. Between the hot soak with the alkylene polyol, or equivalent material, and the water wash(es), the electrode can optionally be dried.

4 Claims, No Drawings

ELECTRODE LAYER TREATING PROCESS

BACKGROUND OF THE INVENTION

Polytetrafluoroethylene (PTFE), in particulate form, has been employed in preparing not only the active layer of an electrode useful in electrochemical processes, but also in the backing layer thereof. For example, particulate PTFE has been employed to impart hydrophobicity to active carbon particles employed in an active layer of an electrode. Additionally some electrode structures utilize layers of PTFE, either per se, or with pore-forming materials to form protective or backing sheets, viz., protective layers to further wetproof the active carbon black particles contained in the active layer of the electrode. The pore-forming agents are customarily utilized to impart porosity to the overall electrode structure, including in some cases, the active layer, so as to enhance contact with, for example, the oxygen or air employed in the so called "oxygen (air) cathodes". For example, in the case of oxygen (air) cathodes, the oxygen or air is flowed across the face of or bubbled through, such a cathode or cathode layer. Such oxygen (air) cathodes can be employed in chlor-alkali cells to conserve electrical energy by eliminating the formation of hydrogen at the cell cathode and thereby achieving savings estimated as high as 25% in the electrical power required to maintain such chlor-alkali cells.

Of course, when water-soluble, pore-forming agents are employed to produce such backing layers; the pore-forming agent must be removed after formation of such wetproofing (backing) layer and active layer contaiing it. Similarly some electrode structures are formed of two or even three layers, e.g., a two-layer structure wherein a backing layer is joined to an active layer which is then arranged in a cell with some form of current distributor or current collector. Three-layer laminates are composed of a backing layer which is secured to an active layer which in turn is secured to a current collector (distributor). When such structures are formed by lamination using heat and/or pressure, it is considered necessary to remove the pore-forming agent, either before, during or after the formation of the laminated assembly.

In order to retain porosity, it is preferable to remove the pore-forming agent after formation of the laminated assembly, e.g., cathode. In accordance with this invention, it was discovered that after laminating such PTFE-containing active layer, e.g. containing active carbon or carbon black, to the leachable, pore-forming/PTFE-containing hydrophobic backing layer using heat and elevated pressure, e.g., temperatures ranging from about 110° to about 125° C. and pressures ranging from about 4 to about 10 tons per square inch; severe blistering of the layer(s) containing the PTFE occurred when the pore-forming agent was sought to be removed during the subsequent water washing step(s), viz., the water washing operation to which such laminates were subjected after formation thereof. This blistering destroyed the usefulness of the electrodes.

FIELD OF THE INVENTION

The present invention is directed to a sequential treating process for treating laminated structures which include a layer(s) containing PTFE and a water-soluble pore-forming agent(s) which, in the normal course of events, is removed, by one or more water washing step(s) prior to utilization of such a structure in an electrochemical process. The process of this invention imparts enhanced resistance to blistering during such water washing step(s) and hence enhances the structural integrity of such electrodes and the layers contained therein.

PRIOR ART

The Elsevier Sequoia Patent Reports, Volume 5, *Fuel Cell Electrodes: Part* 1, by D. F. Kroon, Jr. and J. K. Dahms, published by Elsevier Sequoir S.A., Lausanne, Switzerland, copyright 1974, at page 62, lines 1 through 4, refers to German Pat. No. 1,285,031 as disclosing a method of producing disc-type porous electrodes by impregnating the discs with ethylene-glycol. The method is disclosed as achieving a reliable packing of the discs with regard to gases and fluids, which is capable of resisting extremely high pressures.

The process of this invention differs significantly from that of German Pat. No. 1,285,031 in that in the present invention there is at least a two-stage sequential process: the first being a hot soak in an alkylene polyol (or other equivalent water-soluble organic material) followed by a water washing stage with or without intermediate drying steps between each such washing operation. On the other hand, in the German patent it is intended that the ethylene glycol remain in the electrode.

While the present invention is not limited to any given theory as to the operation thereof, it is postulated that the ethylene glycol hot soak wets the hydrophobic PTFE-containing layers so that when the laminate is subsequently washed with water to remove the water-soluble pore-forming agent(s) incorporated therein; development of unsymmetrical wetting stresses is prevented since the PTFE-containing layers is water wetted from both sides and blistering is thereby prevented.

DETAILED DESCRIPTION OF THE INVENTION

In accordance with this invention, the laminated electrode is soaked in ethylene glycol, or equivalent alkylene polyol, or other water-soluble organic material capable of wetting said PTFE-containing layers, at temperatures ranging from at least 50° to about 100° C. for time periods ranging from about 10 to about 60 minutes or, in any event, for a sufficient period of time to wet the appropriate layers.

The specific temperatures and time periods during which the aforementioned structures are contacted with the treating agent will vary depending upon several factors, including: the particulate thickness of the active layer, the amount of PTFE employed therein, the porosity of such layer and the particular nature of the pore-forming agent(s), in the appropriate layer. For example, the process of this invention can be applied to three layer laminates (useful as oxygen (air) cathodes in in chlor-alkali cells) described and claimed in copending U.S. patent application Ser. No. 202,585 filed in the name of Frank Solomon of even date herewith and entitled "Three Layer Laminated Matrix Electrode" and U.S. patent application Ser. No. 202,577, filed of even date herewith in the names of Frank Solomon and Charles Grun and entitled "Three Layer Laminate", respectively.

In accordance with this invention, both sides of the electrode structure, whether laminated or not, viz., the backing layer side and the front or current distributor side, are contacted with both ethylene glycol and water sequentially, as indicated above, thereby equalizing the internal stresses on removal of the soluble pore-forming agent from such structures. This prevents blistering.

Suitable organic materials which can be employed according to this invention are characterized by having a combination of properties, viz., (1) a high initial boiling point, e.g., about 90° C. or higher (2) the capability of wetting hydrophobic PTFE and hydrophobic carbon particles; (3) the ability to be soluble and/or miscible in water, so as to permit their removal during subsequent water washing; and (4) that they be non-poisoning to catalyst particles contained in the structures treated in accordance with this invention (in the event a pore-former is used in a hydrophobic layer containing such catalytic particles).

The invention will be illustrated in further detail in the examples which follow. In these examples, all percents, ratios, and parts are by weight unless otherwise indicated.

EXAMPLE 1

(A matrix active layer containing silver catalyzed active carbon particles)

Commercially available ball milled "RB carbon" was found to have an ash content of approximately 12% as received. This "RB carbon" was treated in 38% KOH for 16 hours at 115° C. and found to contain 5.6% ash content after a subsequent furnace operation. The alkali treated "RB carbon" was then treated (immersed) for 16 hours at room temperature in 1:1 aqueous hydrochloric acid (20% concentration). The resulting ash content had been reduced to 2.8%. "RB carbon", deashed as above, was silvered in accordance with the following procedure:

Twenty (20 g) grams of deashed "RB carbon" were soaked in 500 ml of 0.161 N (normal) aqueous $AgNO_3$ with stirring for two hours; the excess solution was filtered off to obtain a filter cake. The retrieved filtrate was 460 ml of 0.123 N $AgNO_3$. The filter cake was rapidly stirred into an 85° C. alkaline formaldehyde solution, prepared using 300 cc (cubic centimeters) water, and 30 cc of 30% aqueous NaOH and 22 cc of 37% aqueous $CH_2O$, to ppt. Ag in the pores of the active carbon.

Calculation indicated that 79% of the 2.58 grams of retained silver in the catalyst was derived from adsorbed silver nitrate.

Separately, "Shawinigan Black", a commercially available acetylene carbon black, was mixed with "Teflon 30" (duPont polytetrafluoroethylene dispersion), using an ultrasonic generator to obtain intimate mixture. 7.2 grams of the carbon black/PTFE mix was high speed chopped, spread in a dish, and then heat treated at 525° F. for 20 minutes. Upon removal and cooling, it was once again high speed chopped, this time for 10 seconds. Then 18 grams of the classified silvered active carbon was added to the 7.2 grams of carbon black-Teflon mix, high speed chopped for 15 seconds, and placed into a fiberizing (fibrillating) apparatus. The apparatus used for fiberizing consists of a Brabender Prep Center, Model D101, with an attached measuring head REO-6 on the Brabender Prep Center and medium shear blades were used. The mixture was added to the cavity of the mixer using 50 cc of 30/70 (by volume) mixture of isopropyl alcohol in water as a lubricant to aid in fibrillating. The mixer was then run for 5 minutes at 30 rpm at 50° C., after which the material was removed as a fibrous coherent mass. This mass was then oven dried in a vacuum oven and was high speed chopped in preparation for rolling.

The chopped particulate material was then passed through a rolling mill, a Bolling rubber mill. The resulting matrix active layer sheet had an area density of 22.5 milligrams per square centimeter and was ready for lamination.

EXAMPLE 2

(A matrix active layer containing platinum catalyzed active carbon particles)

The procedure of Example 1 was repeated except that platinum was deposited on the deashed active ("RB") carbon instead of silver. The 10 to 20 micron classified deashed "RB" carbon had platinum applied thereto in accordance with the procedure described in U.S. Pat. No. 4,044,193 using one (1) weight part of $H_3Pt(SO_3)_2OH$ per 34 weight parts of deashed active carbon.

After fibrillation and upon rolling, the area density of the active layer was determined to be 22.2 milligrams per $cm^2$. This matrix active layer was then ready for lamination.

EXAMPLE 3

(A matrix active layer containing silver catalyzed active carbon particles without heat treatment before fibrillation)

An active layer containing deashed, silver "RB" active carbon was prepared as in Example 1 with the exception that the 70/30 (by weight) "Shawinigan Black"/"Teflon 30" matrixing material was not heat treated before fibrillating. This matrix active layer was heavier than those prepared according to Examples 1 and 2. It had an area density of 26.6 milligrams per $cm^2$ and was ready for lamination.

EXAMPLE 4

(Forming laminated electrodes from the matrix active layers of Examples 1–3 and testing them in alkaline media at current densities of 250 milliamperes per square centimeter and higher)

The active layers prepared in accordance with Examples 1 to 3, respectively, were each laminated to a current distributor and a backing sheet of sodium carbonate-loaded PTFE prepared as follows:

Two hundred cubic centimeters of isopropyl alcohol were poured into an "Osterizer" blender. Then 49 grams of duPont 6A polytetrafluoroethylene were placed in the blender and the PTFE—alcohol dispersion was blended at the "blend" position for approximately one minute. The resulting slurry had a thick pasty consistency. Then another 100 cc of isopropyl alcohol were added in the blender and the mixture was blended (again at the "blend" position) for an additional two minutes.

Then 91 grams of particulate sodium carbonate in isopropanol (Ball milled and having an average particle size of approximately 3.5 microns, as determined by a Fisher Sub Sieve Sizer) were added to the binder. This PTFE—sodium carbonate mixture was then blended at the "blend" position in the "Osterizer" blender for three minutes followed by a higher speed blending at the "liquefying" position for an additional one minute. The resulting PTFE—sodium carbonate slurry was then poured from the blender on to a Buchner funnel and filtered and then placed in an oven at 80° C. where it was dried for three hours resulting in 136.2 grams yield of PTFE—sodium carbonate mixture. This mixture contained approximately 35 weight parts of PTFE and 65 weight parts of sodium carbonate.

This mixture was mildly fibrillated in a Brabender Prep Center with attached Sigma mixer as described above.

After fibrillating, which compresses and greatly attenuates the PTFE, the fibrillated material is chopped to a fine dry powder using a coffee blender, i.e., Type Varco, Inc. Model 228.1.00 made in France. Chopping to the desired extent takes from about 5 to 10 seconds because the mix is friable. The extent of chopping can be varied as long as the material is finely chopped.

The chopped PTFE-$Na_2CO_3$ mix is fed to six inch diameter chrome-plated steel rolls heated to about 80° C. Typically these rolls are set at a gap of 0.008 inch (8 mils) for this operation. The sheets are formed directly in one pass and are ready for use as backing layers in forming electrodes, e.g., oxygen cathodes, with no further processing beyond cutting, trimming to size and the like.

The current distributor was an approximately 0.004 inch diameter nickel woven wire mesh having a 0.0003 inch thick silver plating and the woven strand arrangement tabulated below. The distributor was positioned on one active layer side while the backing layer was placed on the other side of the active layer.

The lamination was performed in a hydraulic press at 100° to 130° C. and using pressures of 4 to 8.5 tons per $in^2$ for several minutes.

These laminates were then treated in accordance with this invention by first hot soaking in ethylene glycol at 75° C. for 20 minutes before water washing at 65° C. for 18 hours. They were then dried.

The laminates were then placed in respective half cells for testing against a counter electrode in thirty percent aqueous sodium hydroxide at temperatures of 70° to 80° C. with an air flow of four times the theoretical requirement for an air cathode and at a current density of 300 milliamperes per $cm^2$. The testing results and other pertinent notations are given below. $CO_2$-free air was used.

TABLE 1

| Active Layer Example | Type of Ag Plated Ni Mesh | Initial Voltage vs. Hg/HgO Ref. Electrode | Useful Life of Matrix Electrode (hrs) | Voltage at Failure |
|---|---|---|---|---|
| 1 | 58 × 60 × .004 | −0.265 volts | 8,925 | −.395 volts(1) |
| 2 | 50 × 50 × .005 | −0.201 volts | 3,512+ | N.A.(2) |
| 3 | 58 × 60 × .004 | −0.282 volts | 3,861 | −.509 volts(3) |

(1)Shortly after 8,925 hours, there was a steep decline in potential and the electrode was judged to have failed.

(2)After 188 days, its voltage was −0.246 volts compared to the Hg/HgO reference electrode (a very slight decline in potential) and this matrix electrode is still on life testing. After being started at 300 milliamperes per $cm^2$, the test current density was changed to 250 milliamperes/$cm^2$.

(3)The final failure was caused by separation of the current distributor from the face of the electrode.

It has been observed repeatedly that failure to soak such laminates in ethylene glycol before water washing to extract the soluble pore-former has consistently resulted in blistering.

What is claimed is:

1. A process for treating a structure containing one or more layer(s) containing polytetrafluoroethylene in conjunction with a water-soluble pore-forming agent(s) comprising contacting said structure with an alkylene polyol which (1) has a high initial boiling point of about 90° C. or higher (2) the capability of wetting polytetrafluoroethylene, (3) the ability to be soluble or miscible in water and (4) is non-poisoning to any catalyst contained therein; and then contacting said structure with water to remove said pore-forming agent.

2. A process as in claim 1 wherein said alkylene polyol is ethylene glycol.

3. A process as in claim 2 wherein said contact with said organic material is conducted at temperatures of about 50° to about 100° C. for time periods of from about 10 to about 60 minutes.

4. A process as in claim 2 wherein said water contact is conducted in a plurality of steps.

* * * * *